US006294080B1

(12) United States Patent
Thakkar et al.

(10) Patent No.: US 6,294,080 B1
(45) Date of Patent: Sep. 25, 2001

(54) HYDROCRACKING PROCESS PRODUCT RECOVERY METHOD

(75) Inventors: Vasant P. Thakkar, Elk Grove Village; Christopher J. Anderle, Schaumburg, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/422,315

(22) Filed: Oct. 21, 1999

(51) Int. Cl.[7] ..... C10G 9/00
(52) U.S. Cl. ..... 208/100; 208/103
(58) Field of Search ..... 208/100, 103, 208/59, 89

(56) References Cited

U.S. PATENT DOCUMENTS

| | | | |
|---|---|---|---|
| 3,260,663 | 7/1966 | Inwood et al. | 208/59 |
| 3,328,290 | 6/1967 | Hengstebeck | 208/89 |
| 3,540,999 | 11/1970 | Jacobs | 208/59 |
| 3,544,448 | 12/1970 | Jacobs | 208/59 |
| 4,283,272 * | 8/1981 | Garwood et al. | 208/103 |

OTHER PUBLICATIONS

Scherzer, J. et al. Hydrocracking Processes *Hydrocracking Science and Technology* (Marcel Dekker, Inc., 1986) pp. 174–183 ISBN 0–8247–9760–4 TP690.4.S34.

* cited by examiner

*Primary Examiner*—Helane E. Myers
(74) *Attorney, Agent, or Firm*—John G. Tolomei; John F. Spears, Jr.

(57) ABSTRACT

A feed stream is first processed in a hydrotreating reaction zone and then the effluent is separated into three fractions in an augmented first high pressure separator. Controlled portions of the middle and heavy boiling point range hydrocarbon fractions from this separator are recycled through a low conversion hydrocracking zone, while the remaining portions of these two fractions are passed into a second high pressure separator for recovery. The recycled hydrocarbons flow into a hydrocracking zone and the effluent of this zone flows into the hydrotreating reaction zone.

9 Claims, 1 Drawing Sheet

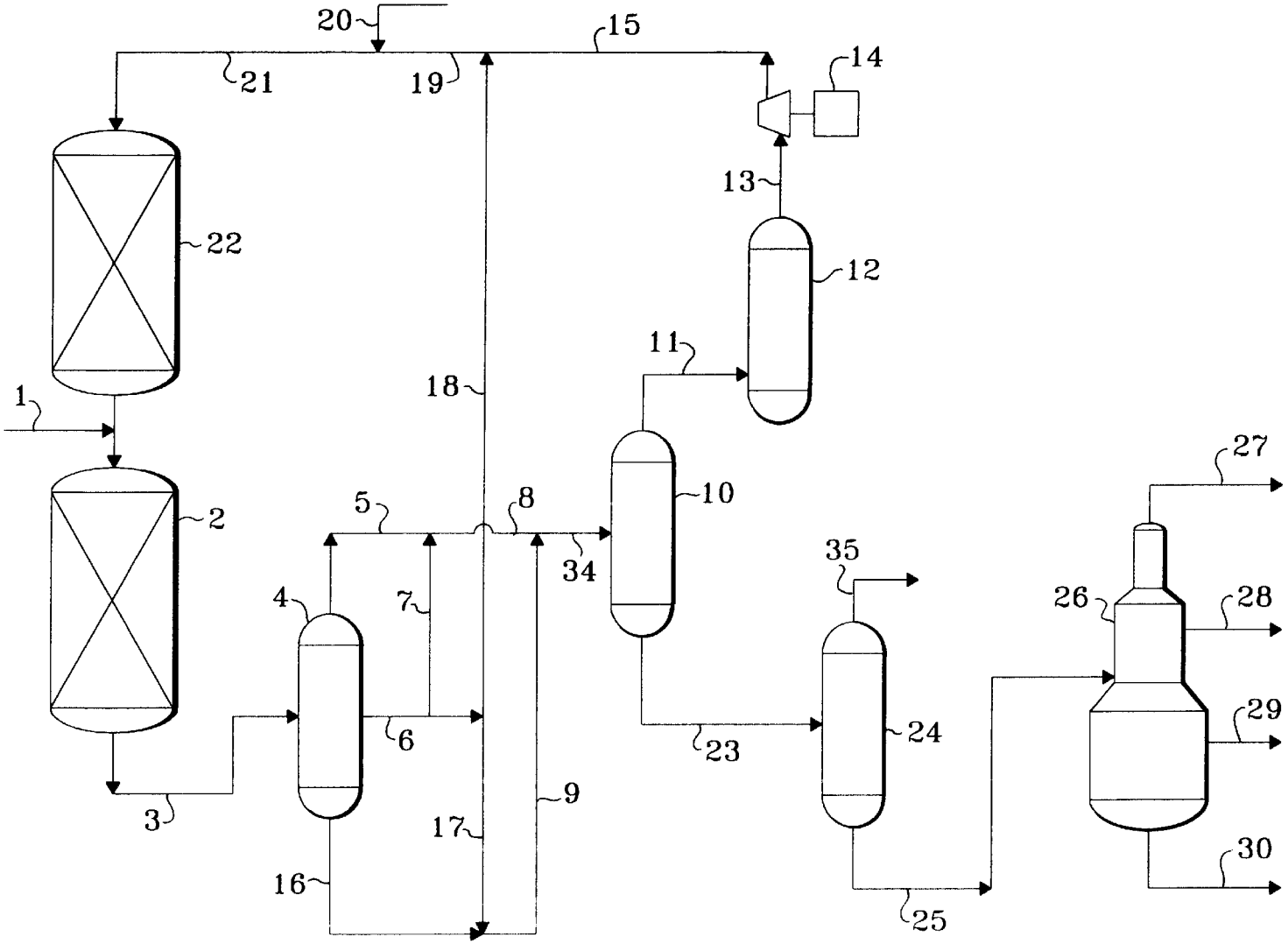
1
2
3
4
5
6
7
8
9
10
11
12
13
14
15
16
17
18
19
20
21
22
23
24
25
26
27
28
29
30
34
35

HYDROCRACKING PROCESS PRODUCT RECOVERY METHOD

FIELD OF THE INVENTION

The invention relates to a hydrocarbon conversion process referred to in the art as hydrocracking. Hydrocracking is used in petroleum refineries to reduce the average molecular weight of heavy or middle fractions of crude oil. The invention more directly relates to an integrated hydrocracking and hydrotreating process which has a specific reactor effluent separation arrangement.

BACKGROUND OF THE INVENTION

Large quantities of petroleum derived hydrocarbons are converted into higher value hydrocarbon fractions used as motor fuel by a refining process referred to as hydrocracking. The high economic value of petroleum fuels has led to extensive development of both hydrocracking catalysts and the process technology. In a hydrocracking process the heavy feed is contacted with a fixed bed of a solid catalyst in the presence of hydrogen at conditions of high temperature and pressure which result in a substantial portion of the molecules of the feed stream being broken down into molecules of smaller size and greater volatility.

The raw feed contains significant amounts of organic sulfur and nitrogen. The sulfur and nitrogen must be removed to meet modern fuel specifications. Removal or reduction of the sulfur and nitrogen is also beneficial to the operation of a hydrocracking reactor. The sulfur and nitrogen is removed by a process referred to as hydrotreating. Due to the similarity of the process conditions employed in hydrotreating and hydrocracking the two processes are often integrated into a single overall process unit having separate sequential reactors dedicated to the two reactions and a common product recovery section.

RELATED ART

Hydrocracking processes are used commercially in a large number of petroleum refineries. They are used to process a variety of feeds ranging from naphtha to very heavy crude oil residual fractions. In general, the hydrocracking process splits the molecules of the feed into smaller (lighter) molecules having higher average volatility and economic value. At the same time a hydrocracking process normally improves the quality of the material being processed by increasing the hydrogen to carbon ratio of the materials, and by removing sulfur and nitrogen.

A general review and classification of the different hydrocracking process flow schemes is provided in the book entitled, "*Hydrocracking Science and Technology*", authored by Julius Scherzer and A. J. Gruia, published in 1996 by Marcel Dekker, Inc. Specific reference may be made to the chapter beginning at page 174 which describes single stage, once-through and two-stage hydrocracking process flow schemes and basic product recovery flows employing vapor-liquid separation zones. This reference also shows that it is known that the feed stream can be passed first into a hydrotreating zone to remove organic nitrogen and sulfur before the feed stream enters the hydrocracking zone.

U.S. Pat. No. 3,260,663 issued to T.U. Inwood et al. shows a multistage hydrocracking process in which the feed is first charged to a hydrotreater 8. The effluent of the hydrotreater flows into a separator 14 having trays 24 in the lower portion of the vessel to aid separation.

U.S. Pat. No. 3,540,999 and 3,544,448 issued to W. L. Jacobs illustrate the use of a hot and a cold high pressure separation zone in series as part of the product recovery section of a hydrocracking process.

U.S. Pat. No. 3,328,290 issued to R. J. Hengstebeck illustrates a hydrocracking process flow in which the feed stream and the effluent of a hydrocracking reactor are passed into a hydrotreating zone. The effluent of the hydrotreating zone is passed into the product recovery zone, with a recycle stream from the product fractionator recycled to the hydrocracking reactor.

SUMMARY OF THE INVENTION

The invention is a combined sequential hydrotreating/low conversion hydrocracking flow scheme characterized by the method employed to separate the effluent of hydroprocessing reactor and the overall process flow. For instance, the entire hydrocracking zone effluent is passed into the hydrotreating zone. The separation method includes recovering distillate products from part of the effluent of the hydrotreating zone. The invention is further distinguished by the passage into the hydrocracking zone of only parts of two specific fractions recovered from the effluent of the hydrotreating zone in a unique separation sequence employing two high pressure separation zones.

A broad embodiment of the invention may be characterized as a method for recovering a product of a hydrocarbon conversion process which employs two reactors, which method comprises separating the effluent stream of a first reactor containing hydrotreating catalyst maintained at hydrotreating conditions in an augmented first high pressure separator and thereby producing a light process stream comprising hydrogen and normally vaporous hydrocarbons, an intermediate process stream, rich in hydrocarbons boiling between 300 and 700° F., and a heavy process stream rich in hydrocarbons having boiling points above 700° F.; passing the light process stream, at least a first portion of the intermediate process stream and at least a first portion of the heavy process stream into a second high pressure separator operated at a pressure within about 100 psi of the first high pressure separator; separating the chemical compounds entering the second high pressure separator into a vapor phase stream which is passed into a second reactor and a liquid phase stream which is passed into a product recovery zone, and recovering a distillate product stream from the product recovery zone.

BRIEF DESCRIPTION OF THE DRAWING

The drawing is a simplified process flow diagram showing the effluent of a low conversion hydrocracking reactor 22 and the primary feed stream 1 flowing into a hydrotreating reactor 2, with the effluent of the hydrotreating reactor flowing into the first of two high pressure separators 4 and 10.

DETAILED DESCRIPTION AND PREFERRED EMBODIMENTS

In a representative example of a conventional high conversion hydrocracking process, a heavy gas oil is charged to the process and admixed with any hydrocarbon recycle stream. The resultant admixture of these two liquid phase streams is heated in an indirect heat exchange means and then combined with a hydrogen-rich recycle gas stream. The admixture of charge hydrocarbons, recycle hydrocarbons and fresh hydrogen is heated as necessary in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream which comprises an admixture of the remaining hydrogen which was not consumed in the reactions, light hydrocarbons such as methane, ethane, propane, butane, and pentane formed by the cracking of the feed hydrocarbons and reaction by-products such as hydrogen sulfide and ammonia formed by hydrodesulfurization and hydro-denitrification reactions which occur within the process. The reaction zone effluent will also contain the desired product hydrocarbons boiling in the gasoline, diesel fuel, kerosene or fuel oil boiling point ranges and some unconverted feed hydrocarbons boiling above the boiling point ranges of the desired products. The effluent of the hydrocracking reaction zone will therefore comprise an extremely broad and varied mixture of individual compounds.

The hydrocracking reaction zone effluent is typically removed from the reactor, heat exchanged with the feed to the reaction zone and then passed into a vapor-liquid separation zone normally referred to as a high pressure separator. Additional cooling can be done prior to this separation. In some instances a hot flash separator is used upstream of the high pressure separator. The use of "cold" separators to remove condensate from vapor removed from a hot separator is another option.

In the general parlance of the hydrocracking art, a "high pressure separator" is a vapor-liquid separation vessel which is maintained at a pressure close to the outlet pressure of preceding reactor. Mixed-phase high pressure reactor effluents are often passed into such separation zones as this allows the separation of the bulk of the hydrogen which is to be recycled to the reactor. This reduces the need for recompression and the cost of recycling the hydrogen. A significant pressure reduction, as down to a pressure below about 500 psig, results in a "low pressure" separation. If only minor and/or incidental cooling of the reactor effluent has been performed, then the separation zone is considered as a "hot" separation. Some heat may be recovered by a traditional reactor feed vs. effluent heat exchange and still result in an effluent of high enough temperature to be considered "hot". A "cold separator" is considered one operating at a temperature of less than about 250° F. and is typically located downstream of heat exchangers producing steam or discharging heat to air or cooling water.

The liquids recovered in these vapor-liquid separation zones are passed into a product recovery zone containing one or more fractionation columns. Product recovery methods for hydrocracking are well known and conventional methods may be employed in the subject invention. In many instances the conversion achieved in the hydrocracking reactor(s) is not complete and some heavy hydrocarbons are removed from the product recovery zone as a "drag stream" which is removed from the process and/or as a recycle stream. The recycle stream is preferably passed into the hydrotreating (first) reactor in a hydrotreating-hydrocracking sequence as this reduces the capital cost of the overall unit. It may, however, sometimes be passed directly into a hydrocracking reactor.

While conventional hydrocracking processes can provide high rates of feed conversion to valuable products and long cycle times between regeneration or replacement of the catalysts, the processes often provide less than desired selectivity to desired products. Much of the feed stream is converted to less desired, lower value by-products. The operation of the unit and the composition of the catalyst and the feed and recycle streams of a hydrocracking unit can be adjusted to maximize the production of desired products. However, many areas for improvement in hydrocracking still remain. It is an objective of the subject invention to provide a hydrocracking process providing flexible operation which may be adjusted to a variety of feed compositions or to compensation for changes in feed composition. A significant percentage of the feed to the subject process may have boiling points within the distillate boiling point ranges of the process. It is not desired to convert these compounds to lower boiling compounds, yet it is normally necessary to hydrotreat the entire feed stream including the compounds in the distillate fuel boiling point ranges. It is therefore another objective of the process to provide a hydrocracking process which can accommodate a feed having distillate boiling point components without promoting overconversion of these components.

While the classical hydrocracking process unit is addressed in terms of a desire to maximize conversion and distillate yields, there are a number of process units where a much lower level of conversion is desired. In these units it may be desired to remove from 40 to 60 volume percent of the feed as unconverted but hydrotreated bottom products. It is a specific objective of the invention to provide a flexible low conversion hydrocracking process which produces a variable amount of well hydrotreated bottoms product.

The subject process achieves this objective through the use of a novel arrangement of sequential high pressure separators. The separator sequence allows control and adjustment of the rate at which intermediate and heavy feed fractions are passed into the hydrocracking zone.

The process feed stream should have a 5% boiling point above 350° F. (177° C.) and preferably above 400° F. (204° C.). Therefore substantially all (at least 90 vol. %) of the process feed stream will fall within the boiling point range between about 300° F. and 1050° F. and preferably between 350° F. and 1000° F. A feed can be made up of a mixture of petroleum fractions from different sources such as atmospheric and vacuum gas oils (AGO and VGO). The feed may contain a substantial percentage, e.g. 20–40 vol %, of material boiling in the diesel boiling point range. Suitable feedstocks for the subject process include virtually any heavy hydrocarbonaceous mineral or synthetic oil or a mixture of one or more fractions thereof. Thus, such known feedstocks as straight run gas oils, vacuum gas oils, demetallized oils, deasphalted vacuum residue, coker distillates, cat cracker distillates, shale oil, tar sand oil, coal liquids and the like are contemplated. The preferred feedstock will have a boiling point range starting at a temperature above about 260° C. (500° F.) and does not contain an appreciable concentration of asphaltenes. The hydrocracking feedstock may contain nitrogen, usually present as organonitrogen compounds in amounts between 1 ppm and 1.0 wt. %. The feed will normally also contain sulfur-containing compounds sufficient to provide a sulfur content greater than 0.15 wt. %.

Conversion conditions employed in the reaction zones of the subject process are within the broad ranges known in the art for hydrocracking and hydrotreating. The conditions chosen should provide only relatively low conversion reaching about 40–50 vol. % per pass conversions of the feedstream components entering the hydrocracking reactor. Hydrocracking and hydrotreating reaction temperatures are in the broad range of 400° to 1200° F. (204–649° C.), preferably between 600° and 950° F. (316–510° C.). Reaction pressures are preferably between about 1000 and about 3000 psi (13,780–24,130 kPa). A temperature above about 316° C. and a total pressure above about 8270 kPa (1200 psi) are highly preferred. The preferred direct connection between the hydrotreating and hydrocracking catalyst beds means that the pressure and temperature in the two catalyst beds will be linked and differ basically only by changes inherent in the operation of the process, e.g. pressure drop through the reaction zone and heat release by the exothermic reactions. However, heating or cooling by indirect heat exchange can be performed between the two zones. Admixture with the primary feed stream may also change the temperature between the reactors. Contact times in a hydrocracking reactor usually correspond to liquid hourly space velocities (LHSV) in the range of about 0.1 $hr^{-1}$ to 15 $hr^{-1}$, preferably between about 0.5 and 3 $hr^{-1}$. In the subject process it is greatly preferred to operate with a significant recycle rate. Hydrogen circulation rates are in the broad range of 1,000 to 50,000 standard cubic feet (scf) per barrel of charge (178–8,888 std. $m^3/m^3$), and preferably between 2,000 and 20,000 scf per barrel of charge (355–3,555 std. $m^3/m^3$). This hydrogen preferably first passes through the hydrotreating reactor(s).

The operation of the subject process can be readily discerned by reference to the drawing. The drawing is a simplified process flow diagram which does not illustrate the many customary pieces of equipment used in the process such as heaters, heat exchangers, pumps, control valves, etc. Referring now to the drawing a primary feed stream carried by line 1 enters the process and is admixed with the effluent of the hydrocracking reactor 22. The resultant admixture of fresh feed hydrocarbons, partially converted hydrocarbons, product hydrocarbons and hydrogen is passed via line 32 to the inlet of the hydrotreating reactor 2. In the hydrotreating reactor 2 the entering materials are contacted with one or more beds of a hydrotreating catalyst or catalysts maintained at hydrotreating conditions. This causes several hydrotreating reactions to occur. These reactions include the saturation of olefinic and aromatic hydrocarbons, and the denitrification and desulfurization of heterocompounds present in the stream entering the reactor. The denitrification and desulfurization reactions respectively form ammonia and hydrogen sulfide. The saturation of the aromatic compounds, which may be mono or multi-ring aromatic compounds, has a number of beneficial results. For instance, the smoke point of jet fuel boiling range hydrocarbons is increased by aromatics saturation, and the refractory nature of multi-ring aromatic hydrocarbons is reduced by hydrogenation.

There is thereby produced a mixed phase, that is vapor and liquid phase, hydrotreating reaction zone effluent stream carried by line 3. This stream comprises a very broad admixture of compounds including hydrogen sulfide, hydrogen, light hydrocarbons such as methane, ethane and butane, naphtha boiling range hydrocarbons, middle distillate boiling range product hydrocarbons and unconverted feed hydrocarbons. This entire stream is passed into an augmented high pressure separator (AHPS) 4. The augmentation consists of vessel internals which promote a better separation into three fractions of different but overlapping compositions. While this could be done much more precisely in a fractionation column, economic constraints render the use of such a large volume, high pressure device impractical. Economics demands a crude separation. Thus, there is no refluxing or reboiling of the AHPS.

The AHPS 4 is designed and operated to separate the entering chemical compounds into at least 3 separate process streams. The lightest process stream comprises the hydrogen, $H_2S$ and lightest hydrocarbons. This process stream is referred to as a 300° F. minus stream and is removed from the top of the AHPS 4 through line 5 as a vapor phase stream. The terminology 300° minus is intended to indicate it contains those hydrocarbons having boiling points below 300° F. An intermediate process stream comprising mostly hydrocarbons having boiling points between about 300 to 700° F. is withdrawn as a sidecut through line 6. The third process stream withdrawn from the AHPS 4 comprises the heaviest of the compounds which enter the separator and it should contain primarily compounds having boiling points above 700° F. It will, however, contain some lighter material. The light process stream, that is the stream of line 5 is combined with a first portion of the intermediate process stream carried by line 7 and passed through lines 8 and 34 into a second high pressure separator (HPS) 10. Also passed into the second high pressure separator 10 is a first portion of the liquid-phase heavy process stream removed from the AHPS 4 through line 16. This heavy material, carried by line 9, and the intermediate fraction carried by line 7 are intended to be concentrated into a stream eventually withdrawn from the process.

The second high pressure separator 10 is designed and operated at conditions to cause the separation of the entering compounds into a vapor-phase stream removed through line 11, comprising most of the hydrogen, $H_2S$ and very light gases present in the effluent of the hydrotreating reactor 2, plus a liquid phase stream removed through line 23 and comprising the remainder of the compounds which enter the high pressure separator 10. Line 23 passes this liquid phase material into a low pressure flash drum 24, with the resultant reduction in pressure releasing a sizeable fraction of the normally gaseous hydrocarbons and other gases dissolved in the liquid phase material of line 23. This vapor-phase material is removed from the process through line 35 for further processing as appropriate. The remainder of the material entering the LPFD 24 is concentrated into a liquid phase stream carried by line 25. This stream is passed into a product recovery or product fractionation zone represented in the drawing by a single fractionation column 26. More than one fractionation column can be employed to separate and recover the various hydrocarbons flowing through line 25. This separation will cause the formation of an overhead stream carried by line 27, which may be a light naphtha hydrocarbon boiling range stream. One or more distillate product streams such as a kerosene boiling range product stream carried by line 28 and a diesel fuel boiling range product stream carried by line 29 are also removed from the product recovery zone 26. Finally, the unconverted oil is withdrawn from fractionation column 26 by line 30. As previously mentioned, this unconverted oil has passed through at least one of the reaction zones of the subject process and has therefore been exposed to the beneficial effects of hydrogenation. The unconverted oil of line 30 therefore will be significantly different in nature than the equivalent components of the feedstream of line 1. The unconverted oil has been extensively hydrotreated. It is thus a very good feed for passage into an FCC zone, an ethylene cracking zone or a lube oil plant.

The vapor phase stream removed from second high pressure separator 10 via line 11 may be passed into an optional scrubbing zone 12 wherein acid gases including hydrogen sulfide may be removed by contact with a solvent such as a conventional aqueous amine solution. This produces a purified hydrogen-rich gas stream flowing through line 13. The scrubbing zone is usually operated at a lower, near ambient, temperature than the reaction zone necessitating the cooling and reheating of the recycle gas by heat exchangers not shown on the drawing. Condensate formed from cooling is preferably collected in a separator not shown and passed into the product recovery section of the process. This recycle gas stream is boosted in pressure by the recycle compressor 14 and then passed through line 15 to the junction with line 18.

Line 18 carries an admixture formed from portions of the intermediate process stream and the heavy process streams; that is, the 300 to 700° F. hydrocarbons from the AHPS 4 plus a fraction of the 700° F. plus material removed via line 16 from the AHPS. Line 18 therefore carries the recycle hydrocarbon stream of the subject process. This stream is combined with the recycle hydrogen stream of line 15 and passed through line 19. Makeup hydrogen from line 20 is added to this admixture and it then flows through line 21 into the hydrocracking reactor 22. The reactor 22 is maintained at low conversion hydrocracking conditions by heaters and/or heat exchangers not shown. Contact of the entering admixture of hydrogen and hydrocarbons with the hydrocracking catalyst(s) retained in the reactor at hydrocracking conditions results in a partial conversion of the entering materials to lower boiling hydrocarbons. A sweet, that is, low hydrogen sulfide and low sulfur environment is maintained in the hydrocracking reactor due to the use of the upstream hydrotreating reactor 2 and scrubber 12. This will result in the hydrocracking catalyst having a significant hydrogenation capability. Some hydrogenation will therefore occur in the hydrocracking reactor.

If desired, a different hydrocracking feed may be passed into the process through line 31. This will preferably be a sweet, that is, low sulfur and low nitrogen feedstream having a lower average boiling point than the primary feed stream.

The amounts of the intermediate and heavy fractions which are passed into the second high pressure separator and the remaining amounts which are passed into the hydrocracking zone are adjustable to accommodate changes in such variables as the feed composition, the desired product distribution or quality or changes in catalyst activity and selectivity. An amount equal to at least 25 vol. % of each stream is preferably sent to each destination. That is, at least 25 and possibly up to about 75 vol. % of the intermediate fraction and of the heavy fraction removed from the first high pressure separator is passed into the hydrocracking zone 22. The entire remainder of these streams is passed into the second high pressure separator 10.

It is therefore apparent that the subject process is characterized by the use of two high pressure separators in series, with the first separator forming three streams of relative light, intermediate and heavy materials. Only a portion of the heavy and intermediate fraction, but all of the light fraction enter the second high pressure separator. The division and separate handling of the light, intermediate and heavy process streams removed from the first high pressure separator distinguish the subject process from those of the art.

One embodiment of the invention may accordingly be characterized as a hydrocarbon conversion process which comprises passing a feed stream through a first reactor containing hydrotreating catalyst maintained at hydrotreating conditions, and producing a first effluent stream; passing the first effluent stream into an augmented first high pressure separator wherein the first effluent stream is separated into at least a light stream comprising hydrogen and normally vaporous hydrocarbons, an intermediate stream comprising hydrocarbons boiling between 300 and 700° F. and a heavy stream rich in hydrocarbons having boiling points above 700° F.; passing the light stream, at least a first portion of the intermediate stream and at least a first portion of the heavy stream into a second high pressure separator operated at a pressure within about 100 psi of the first high pressure separator; passing a second portion of the heavy stream through a second reactor which contains hydrocracking catalyst maintained at hydrocracking conditions and generating a second effluent stream; passing the second effluent stream into the first reactor; and separating the chemical compounds entering the second high pressure separator into a vapor phase stream which is passed into the second reactor and a liquid phase stream which is passed into a product recovery zone, and recovering a distillate product stream from the product recovery zone. As used herein, the term "rich" is intended to mean a concentration of the indicated compound or type of compounds greater than 50 mole % and preferably greater than 70%. In specific cases such as hydrogen streams, the term "rich" will often indicate a much higher concentration exceeding 90 mol %.

Suitable catalysts for use in all reaction zones of this process are available commercially from a number of vendors. The primary difference between the hydrocracking and hydrotreating catalysts is the presence of a cracking component in the hydrocracking catalyst. The catalysts will both otherwise comprise hydrogenation components (metals) and inorganic oxide support components. It is preferred that the hydrocracking catalyst comprises between 1 wt. % and 90 wt. % Y zeolite, preferably between 10 wt. % and 80 wt. % as a cracking component. In the case of a monolith catalyst, compositions are in terms of the active wash coat layer unless otherwise stated. Such a zeolitic catalyst will normally also comprise a porous refractory inorganic oxide support (matrix) which may form between about 10 and 99 wt. %, and preferably between 20 and 90 wt. % of the finished catalyst composite. The matrix may comprise any known refractory inorganic oxide such as alumina, magnesia, silica, titania, zirconia, silica-alumina and the like and preferably comprises a combination thereof such as silica-alumina. It is preferred that the support comprises from about 5 wt. % to about 45 wt. % alumina. A highly preferred matrix for a particulate hydrocracking catalyst comprises a mixture of silica-alumina and alumina wherein the silica-alumina comprises between 15 and 85 wt. % of said matrix.

Y zeolite has the essential X-ray powder diffraction pattern set forth in U.S. Pat. 3,130,007. The as synthesized zeolite is modified by techniques known in the art which provide a desired form of the zeolite. Modification techniques such as hydrothermal treatment at increased temperatures, calcination, washing with aqueous acidic solutions, ammonia exchange and any known combination of these are contemplated. A Y-type zeolite preferred for use in the present invention possesses a unit cell size between about 24.20 Angstroms and 24.45 Angstroms. Preferably, the zeolite unit cell size will be in the range of about 24.20 to 24.40 Angstroms and most preferably about 24.30 to 24.38 Angstroms. The Y zeolite is preferably dealuminated and has a framework $SiO_2$:$Al_2O_3$ ratio greater than 6, most preferably between 6 and 25. It is contemplated that other zeolites, such as Beta, Omega, L or ZSM-5, could be employed as the zeolitic component of the hydrocracking catalyst in place of or in addition to the preferred Y zeolite.

A silica-alumina component of the hydrocracking or hydrotreating catalyst may be produced by any of the numerous techniques which are well described in the prior art relating thereto. Such techniques include the acid-treating of a natural clay or sand, and co-precipitation or successive precipitation from hydrosols. An alumina component of the catalysts may be any of the various suitable hydrous aluminum oxides or alumina gels such as alpha-alumina monohydrate of the boehmite structure, alpha-alumina trihydrate of the gibbsite structure, beta-alumina trihydrate of the bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858.

A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The finished catalysts for utilization in the subject process should have a surface area of about 200 to 700 square meters per gram, a pore diameter range of about 20 to about 300 Angstroms, a pore volume of about 0.10 to about 0.80 milliliters per gram, and an apparent bulk density within the range of from about 0.50 to about 0.90 gram/cc. Surface areas above 350 $m^2/g$ are greatly preferred.

The composition and physical characteristics of the catalysts such as shape and surface area are not considered to be limiting in the utilization of the present invention. The catalysts may, for example, exist in the form of pills, pellets, granules, broken fragments, spheres, or various special shapes such as trilobal extrudates, disposed as a fixed bed within a reaction zone. The catalyst particles may be prepared by any method known in the art including the well-known oil drop and extrusion methods. A multitude of different extrudate shapes are possible, including, but not limited to, cylinders, cloverleaf, dumbbell and symmetrical and asymmetrical polylobates. It is also within the scope of this invention that the uncalcined extrudates may be further shaped to any desired form by means known to the art.

A spherical catalyst may be formed by use of the oil dropping technique such as described in U.S. Pat. Nos. 2,620,314; 3,096,295; 3,496,115 and 3,943,070, which are incorporated herein by reference for their teaching on the performance of this technique. Preferably, this method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an ammoniacal solution to further improve their physical characteristics. The resulting aged and gelled particles are then washed and dried at a relatively low temperature of about 50–200° C. and subjected to a calcination procedure at a temperature of about 450–700° C. for a period of about 1 to about 20 hours. This treatment effects conversion of the hydrogel to the corresponding alumina matrix. The zeolite and silica-alumina must be admixed into the aluminum containing sol prior to the initial dropping step. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

Hydrogenation components may be added to the catalysts before or during the forming of the catalyst particles, but the hydrogenation components of the hydrocracking catalyst are preferably composited with the formed support by impregnation after the zeolite and inorganic oxide support materials have been formed to the desired shape, dried and calcined. Impregnation of the metal hydrogenation component into the catalyst particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on techniques for the preparation of hydrocracking catalysts may be obtained by reference to U.S. Pat. Nos. 3,929,672; 4,422,959; 4,576,711; 4,661,239; 4,686,030; and 4,695,368 which are incorporated herein by reference for this teaching.

Hydrogenation components contemplated for use in the catalysts are those catalytically active components selected from the Group VIB and Group VIII metals and their compounds. References herein to Groups of the Periodic Table are to the traditionally American form as reproduced in the fourth edition of *Chemical Engineer's Handbook*, J. H. Perry editor, McGraw-Hill, 1963. Generally, the amount of hydrogenation component(s) present in the final catalyst composition is small compared to the quantity of the other support components. The Group VIII component generally comprises about 0.1 to about 30% by weight, preferably about 1 to about 20% by weight of the final catalytic composite calculated on an elemental basis. The Group VIB component of the hydrocracking catalyst comprises about 0.05 to about 30% by weight, preferably about 0.5 to about 20% by weight of the final catalytic composite calculated on an elemental basis. The total amount of Group VIII metal and Group VIB metal in the finished catalyst in the hydrocracking catalyst is preferably less than 21 wt. percent. Concentrations of any of the more active and also more costly noble metals will be lower than for base metals e.g. 0.5–2.5 wt. %. The hydrogenation components contemplated for inclusion in the catalysts include one or more metals chosen from the group consisting of molybdenum, tungsten, chromium, iron, cobalt, nickel, platinum, palladium, iridium, osmium, rhodium, and ruthenium. The hydrogenation components will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the hydrotreating catalyst. If used phosphorus is normally present in the catalyst in the range of 1 to 30 wt. % and preferably 3 to 15 wt. % calculated as $P_2O_5$.

What is claimed is:

1. A method for recovering a product of a hydrocarbon conversion process which employs two reactors, which method comprises:

a) separating the effluent stream of a first reactor containing hydrotreating catalyst maintained at hydrotreating conditions in a first high pressure separator augmented with vessel internals to promote better separation and thereby producing a light process stream comprising hydrogen and normally vaporous hydrocarbons, an intermediate process stream, rich in hydrocarbons boiling between 300 and 700° F., and a heavy process stream rich in hydrocarbons having boiling points above 700° F.;

b) passing the light process stream, a first portion of the intennediate process stream and a first portion of the heavy process steam into a second high pressure separator operated at a pressure within about 100 psi of the first high pressure separator;

c) separating the chemical compounds entering the second high pressure separator into a vapor phase stream which is passed into a second reactor and a liquid phase stream which is passed into a product recovery zone, and recovering a distillate product stream from the product recovery zone.

2. The process of claim 1 wherein a second portion equal to at least 25 vol percent of the intermediate process stream is passed directly into the second reactor.

3. The process of claim 2 wherein a second portion equal to at least 25 vol. percent of the heavy process stream is passed into the second reactor.

4. The process of claim 3 wherein the effluent of the second reactor is passed into the first reactor.

5. The process of claim 4 wherein the second reactor contains hydrocracking catalyst maintained at hydrocracking conditions.

6. A hydrocarbon conversion process which comprises:

a) passing a feed stream through a first reactor containing hydrotreating catalyst maintained at hydrotreating conditions, and producing a first effluent stream;

b) passing the first effluent stream into a first high pressure separator augmented with vessel internals to promote better separation and wherein the first effluent stream is separated into at least a light stream comprising hydrogen and normally vaporous hydrocarbons, an intermediate stream comprising hydrocarbons boiling between 300 and 700° F. and a heavy stream rich in hydrocarbons having boiling points above 700° F.;

c) passing the light stream, at least a first portion of the intermediate stream and at least a first portion of the heavy stream into a second high pressure separator operated at a pressure within about 100 psi of the first high pressure separator;

d) passing a second portion of the heavy stream through a second reactor which contains hydrocracking catalyst maintained at hydrocracking conditions and generating a second effluent stream;

e) passing the second effluent stream into the first reactor; and, f) separating the chemical compounds entering the second high pressure separator into a vapor phase stream which is passed into the second reactor and a liquid phase stream which is passed into a product recovery zone, and recovering a distillate product stream from the product recovery zone.

7. The process of claim 6 wherein a second portion of the intermediate stream is passed directly into the second reaction zone.

8. The process of claim 6 wherein a second feed, having a lower average boiling point than the feed stream passed into the first reactor, is passed into the second reactor.

9. A hydrocarbon conversion process which comprises:

a) passing a feed stream through a first reactor containing hydrotreating catalyst maintained at hydrotreating conditions, and producing a first effluent stream, b) passing the first effluent stream into a first high pressure separator augmented with vessel internals to promote better separation and wherein the first effluent stream is separated into a light stream comprising hydrogen and normally vaporous hydrocarbons, an intermediate stream rich in hydrocarbons boiling between 300 and 700° F. and a heavy stream rich in hydrocarbons having boiling points above 700° F.;

c) passing the light stream, a first portion of the intermediate stream and a first portion of the heavy stream into a second high pressure separator operated at a pressure within 100 psi of the first high pressure separator;

d) passing a second portion of the heavy stream and a second portion of the intermediate stream through a second reactor which contains hydrocracking catalyst maintained at hydrocracking conditions and generating a second effluent stream;

e) passing the second effluent stream into the first reactor; and, f) separating the chemical compounds entering the second high pressure separator into a vapor phase stream which is passed into the second reactor and a liquid phase stream which is passed into a product recovery zone; and, g) recovering a distillate hydrocarbon product stream and an unconverted oil product stream from the product recovery zone.

* * * * *